US011242670B2

(12) United States Patent
Wager et al.

(10) Patent No.: US 11,242,670 B2
(45) Date of Patent: Feb. 8, 2022

(54) WORK MACHINE HAVING A BALLAST DEVICE

(71) Applicant: Liebherr-Hydraulikbagger GmbH, Kirchdorf/Iller (DE)

(72) Inventors: Bernd Wager, Kirchdorf (DE); Dirk Asam, Ulm (DE)

(73) Assignee: LIEBHERR-HYDRAULIKBAGGER GMBH, Kirchdorf/Iller (DE)

( * ) Notice: Subject to any disclaimer, the term of this patent is extended or adjusted under 35 U.S.C. 154(b) by 352 days.

(21) Appl. No.: 15/836,551

(22) Filed: Dec. 8, 2017

(65) Prior Publication Data

US 2018/0163370 A1 Jun. 14, 2018

(30) Foreign Application Priority Data

Dec. 9, 2016 (DE) ..... 10 2016 014 659.1

(51) Int. Cl.

| | |
|---|---|
| ***E02F 9/18*** | (2006.01) |
| ***B66C 23/72*** | (2006.01) |
| ***E02F 9/08*** | (2006.01) |
| ***E02F 9/24*** | (2006.01) |

(52) U.S. Cl.

CPC ..... *E02F 9/18* (2013.01); *B66C 23/72* (2013.01); *E02F 9/0808* (2013.01); *E02F 9/24* (2013.01)

(58) Field of Classification Search

CPC ..... E02F 9/18; B66C 23/72; B66F 9/07554

See application file for complete search history.

(56) References Cited

U.S. PATENT DOCUMENTS

| | | | | | |
|---|---|---|---|---|---|
| 2,325,089 | A * | 7/1943 | Zeilman | 212/178 | |
| 2,797,121 | A | 6/1957 | Aud | | |
| 2,820,556 | A * | 1/1958 | Davis | E02F 3/30 | 414/719 |
| 3,023,024 | A | 2/1962 | McAdams et al. | | |
| 3,795,330 | A * | 3/1974 | Jorgensen | E02F 9/18 | 414/719 |
| 4,068,876 | A * | 1/1978 | Muellner | B62D 49/085 | 280/759 |
| 4,402,413 | A * | 9/1983 | Sickler | E02F 9/18 | 212/178 |
| 2006/0242791 | A1* | 11/2006 | Inoue | B66F 9/07504 | 16/113.1 |
| 2013/0127157 | A1* | 5/2013 | Oakes | F16L 23/028 | 285/223 |
| 2015/0246795 | A1* | 9/2015 | Copeland | B66C 23/76 | 414/719 |

FOREIGN PATENT DOCUMENTS

| | | | | |
|---|---|---|---|---|
| DE | 2254951 | A1 * | 5/1974 | B62D 37/04 |
| DE | 29621600 | U1 | 2/1997 | |
| JP | H072490 | A | 1/1995 | |
| JP | H11180683 | A | 7/1999 | |

* cited by examiner

*Primary Examiner* — Michael S Lowe
(74) *Attorney, Agent, or Firm* — McCoy Russell LLP

(57) ABSTRACT

The present disclosure relates to a work machine, in particular to a hydraulic excavator, having at least one ballast device, wherein the ballast device comprises at least one ballast weight and at least one ballast support. The present disclosure is furthermore directed to a ballast weight for a corresponding work machine.

18 Claims, 5 Drawing Sheets

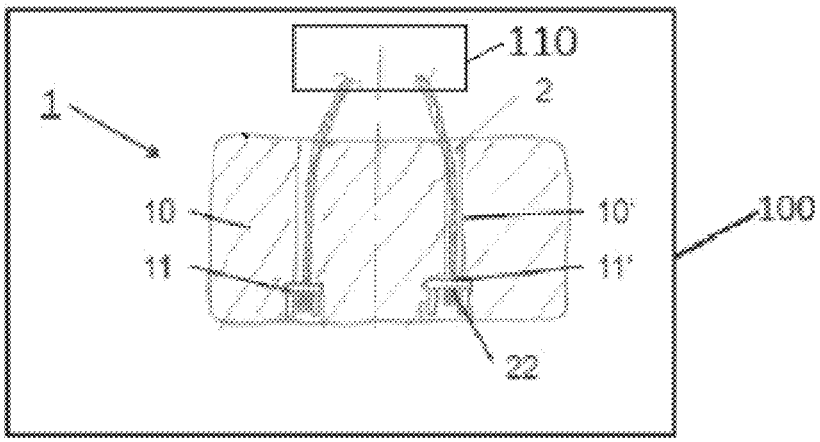
FIG. 1
FIG. 2
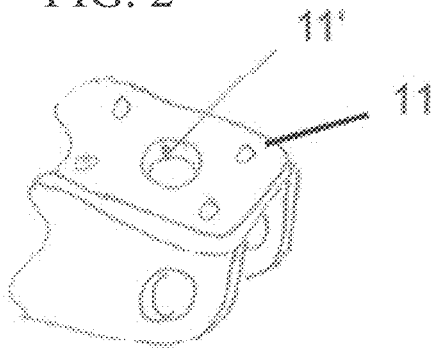
FIG. 3A
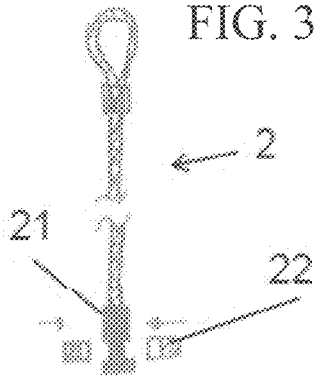
FIG. 3B
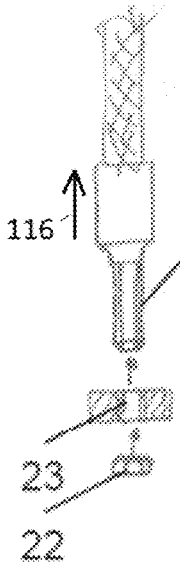
FIG. 3F
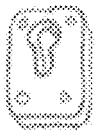
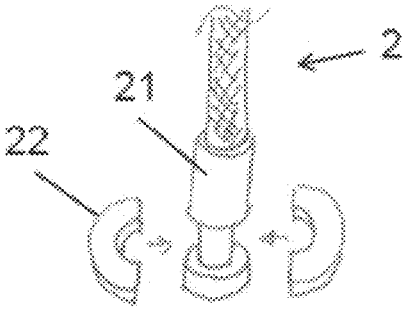
FIG. 3C
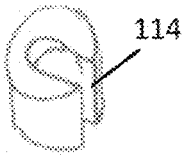
FIG. 3D
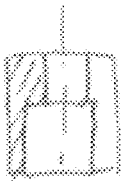
FIG. 3E FIG. 4G
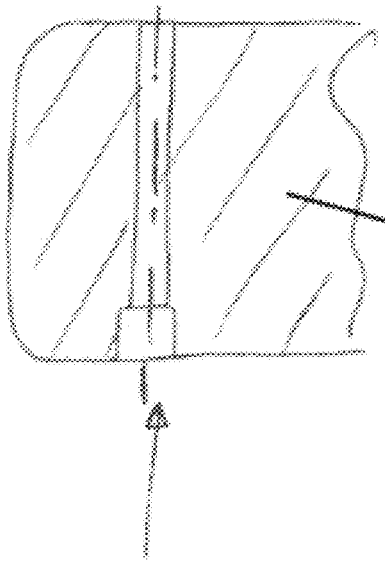
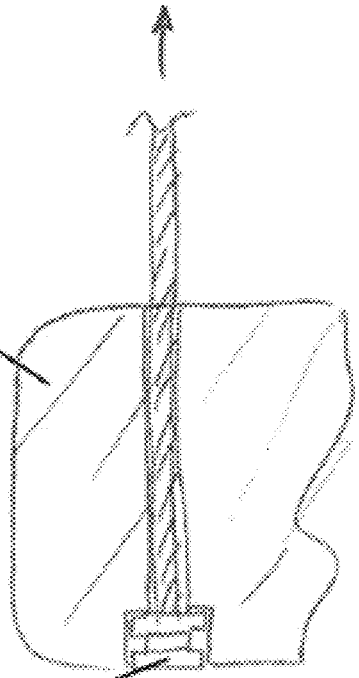
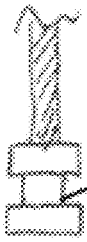
FIG. 4H
FIG. 4I
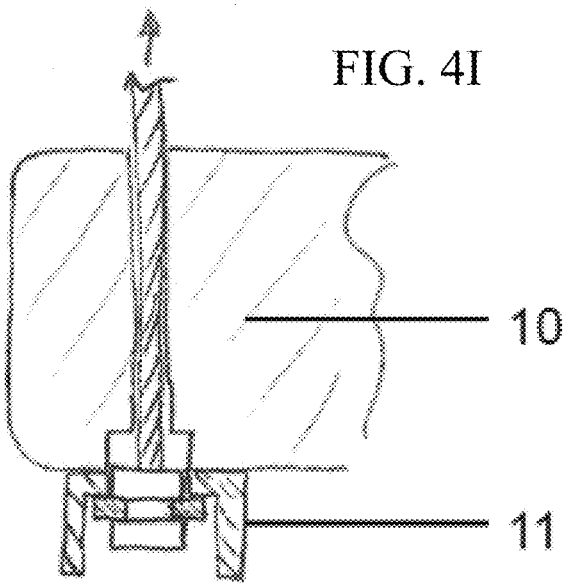

WORK MACHINE HAVING A BALLAST DEVICE

CROSS REFERENCE TO RELATED APPLICATION

This application claims priority to German Patent Application No. 10 2016 014 659.1, entitled "WORK MACHINE HAVING A BALLAST DEVICE," filed Dec. 9, 2016, the entire contents of which is hereby incorporated by reference in its entirety for all purposes.

TECHNICAL FIELD

The present disclosure relates to a work machine, in particular to a hydraulic excavator, having at least one ballast device, wherein the ballast device comprises at least one ballast weight and at least one ballast support.

BACKGROUND

Work machines in the prior art provide eye bars that can lift, for example, a cast ballast or of a slewing platform of the work machine. The eye bars can in this respect be components of the cast ballast. It is also known to use a lifting beam, beneath a corresponding slewing platform, for example, to be able to manipulate or lift the cast ballast and/or the work machine and/or the slewing platform accordingly.

It is disadvantageous that the cast ballast does not have any defined security for lifting points or threads provided at them since shrink holes that occur in cast ballast can act in a disadvantageous and unpredictable manner or in a simply determinable manner on the stability of the cast ballast.

It is furthermore known from welded ballast to integrate a complex support structure in the ballast weight or to integrate it with the ballast weight. Two lifting points can, for example, be provided at the ballast in this context that can be used, for example, in combination with two further lifting points, e.g. at the mono boom, for raising the entire work machine or the ballast.

Against this background, it is the object of the present disclosure to provide a work machine that enables a simpler and/or safer lifting of its ballast weight, the work machine itself, or parts thereof.

SUMMARY

A work machine is accordingly provided in which the ballast weight and the ballast support each comprise at least two passages that are aligned with one another.

The ballast support can, for example, be configured as a metal support that is part of the structure of the work machine and is in particular part of a superstructure of the work machine. The ballast weight can be one or more bodies that are, for example, produced from metal or from concrete and that can be placed on the ballast support in dependence on the required ballast weight, optionally in different numbers.

The at least one ballast weight and the at least one ballast support can each comprise two passages that can be aligned with one another in at least one position of the ballast weight and the ballast support. The passages make it possible to lead a connection means through them and to connect them to structures, for example of the ballast supports, that can be located beneath the ballast weight. A region can hereby be used for coupling coupling means to the work machine that, on the one hand, is a statically advantageous region for lifting the ballast weight and/or the work machine and, on the other hand, allows the need for other devices for the lifting, such as eye bars or lifting beams, to be omitted.

In an embodiment in which the ballast support is part of a slewing platform of the work machine, the individual load-bearing components of the apparatus on the lifting of the work machine and/or of the ballast weight can be the slewing platform itself and the connection means led through the passages. The ballast weight does not therefore have to be designed for bearing additional weight, but it is rather sufficient only to design it for bearing its own weight. An advantageously simple design of the ballast weight or of the ballast weights is hereby made possible, which decreases manufacturing costs.

The embodiment of the work machine in accordance with the present disclosure furthermore makes possible a modular design of the apparatus, with coupling means or connection means in particular optionally being able to be provided with the work machine or optionally being able to be subsequently retrofitted.

The coupling means can furthermore be assembled and disassembled easily, which can also take place on a construction-site use of the work machine and does not have to take place, as known from the prior art, ex works or during the manufacture of the work machine. The assembly and disassembly of the coupling means can thus also take place retroactively on an already existing work machine.

A further advantage of the work machine in accordance with the present disclosure comprises being able to retroactively convert already existing work machines or slewing platforms or superstructures, for example by only slight modifications so that a work machine in accordance with the present disclosure can be provided.

A work machine in accordance with the present disclosure furthermore provides the advantage that disassembled ballast can also be raised simply by means of corresponding coupling means while using the passages provided at the ballast weight and/or the ballast support.

The passages in the ballast support and/or in the ballast weight can in particular be arranged in a vertical direction or in a direction differing from the vertical in a configuration ready for operation, for example with a ballast in place. The introduction of coupling means into the passages is hereby facilitated. It is also ensured in this manner that the coupling means extending in the passages are substantially arranged in the direction of force, whereby the risk of damage to the coupling means can be reduced. The direction of force in this context designates the direction in which the force acts that is transmitted by the coupling means.

It is conceivable in an embodiment of the present disclosure that the passages are aligned with one another in a state of the work machine in that the work machine is at least partly ballast-compensated by the ballast weight. It is meant by this that the work machine is in a state in which it is ready to carry out work, i.e. is inter alia also sufficiently ballast-compensated. It is thus not necessary to convert the work machine into a different state in a laborious manner to lift the work machine or the ballast. The work machine or the ballast can thus be lifted simply and quickly.

It is conceivable in a further embodiment that at least one of the passages is formed as a bore, as a casting channel, as an inserted hollow section, and/or as a cut-out channel, and/or that at least one of the passages comprises at least one bore, at least one casting channel, at least one inserted hollow section and/or at least one cut-out channel. It can thus be simply possible to convert or reconfigure an existing ballast support by carrying out corresponding drilling work such that it can be used in a work machine in accordance with the present disclosure or as a part of a work machine in accordance with the present disclosure. The further named possibilities represent embodiments in which corresponding passages can be provided in a simple manner.

It is conceivable in a further embodiment that at least one respective coupling means, in particular a steel cable, a chain and/or a bar, is provided within the passages. A combined coupling means is also conceivable that combines different ones of the named embodiments, optionally in different numbers. The coupling means can in particular be configured to connect the work machine or the ballast to a lifting apparatus for lifting the ballast and/or the work machine. It is also conceivable that the ballast can be lifted by the work machine itself, for example by means of an excavator arm or a crane boom of the work machine, via the corresponding coupling means and using the passages.

Provision can be made in an embodiment that a coupling section is in particular provided at an end region of the coupling means. The coupling section can be configured to establish a connection to the ballast support and/or to the ballast weight.

Provision can be made in this context in a further embodiment of the present disclosure that the coupling section is coupled or couplable to a counter-coupling section for fixing the coupling means to the ballast device. The counter-coupling section can in this respect be formed in one part or in two parts.

It is conceivable in a further embodiment that the coupling section and the counter-coupling section each comprise a thread. The embodiment of the coupling section as a component having an external thread is conceivable in this respect, while the counter-coupling section is configured as a component having an internal thread such as a nut.

It is conceivable in a further embodiment that the ballast device is arranged at a superstructure of the work machine. The ballast device can here be coupled to the superstructure via the ballast support. The ballast support can be permanently connected to the superstructure or can be releasably connected to the superstructure. The ballast support can thus optionally be lifted together with the ballast weight to lift the ballast.

The present disclosure is furthermore directed to a ballast weight for use with a work machine or for a work machine, with the ballast weight comprising a slope and/or where the upper region of the passages is wider than the lower region. The widening or the slope can be configured such that a coupling means led through it is in particular preserved or protected from damage on oscillation movements of the lifted load.

Further details and advantages of the present disclosure are explained with reference to the embodiment shown by way of example in the Figures.

BRIEF DESCRIPTION OF THE FIGURES

FIG. 1 shows a cross-sectional view through a ballast weight and a ballast support.

FIG. 2 shows a detailed view of a part of a ballast support.

FIGS. 3A-F show detailed views of the coupling means and of the coupling sections and counter-coupling sections.

FIGS. 4A-I show different embodiments of the ballast weight.

DETAILED DESCRIPTION

Figure 4A:
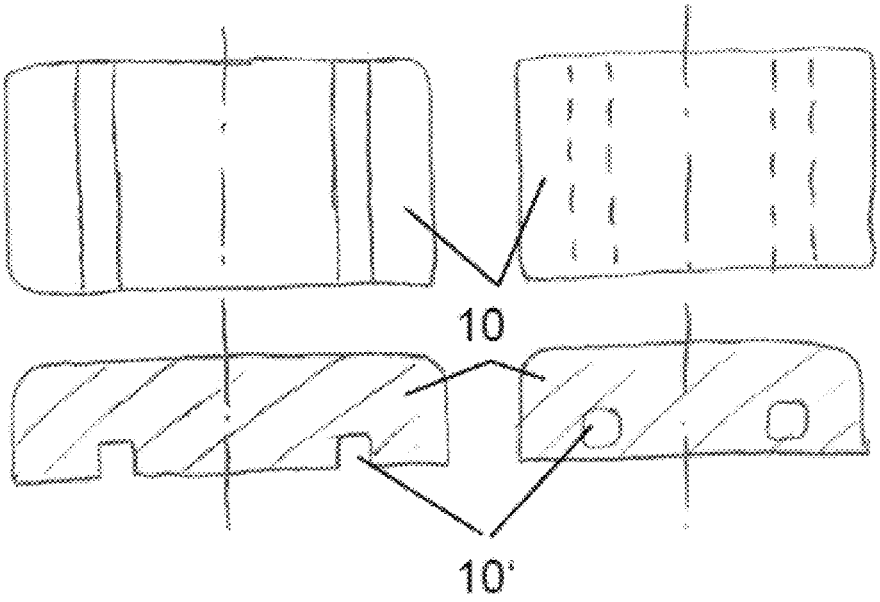

FIG. 1 shows the ballast weight 10 and the ballast support 11 of a work machine in accordance with the present disclosure, with the work machine, for example, being able to be a hydraulic excavator or a crane. The ballast support 11 and the ballast weight 10 can be called a ballast device 1 or can comprise it. The ballast support 11 can, for example, comprise two carriers, in particular two carriers arranged in parallel. The at least two passages 10', 11' that are aligned with one another in the state (shown in FIG. 1) of the work machine 100 can be provided within the ballast weight 10 and the ballast support 11.

It is conceivable in a further embodiment that the ballast device is arranged at a superstructure 110 of the work machine 100. The ballast device can here be coupled to the superstructure via the ballast support. The ballast support can be permanently connected to the superstructure or can be releasably connected to the superstructure. The ballast support can thus optionally be lifted together with the ballast weight to lift the ballast.

FIG. 1 shows an embodiment in which a single ballast weight 10 is arranged on two ballast supports 11. Embodiments having different numbers of ballast weights 10 and ballast supports 11 are likewise conceivable and covered by the present disclosure. It is in particular conceivable that a plurality of ballast weights 10 positioned over one another are arranged on two or more ballast supports 11.

It is naturally conceivable that more than two passages 10', 11' can be present. The passages 10', 11' can at least be arranged such that the center of mass of the ballast weight 10 and/or of the ballast support 11 and/or of the work machine is located in a region below and between the passages 10', 11'.

It is also conceivable to establish the passages 10' in the ballast weight 10 retroactively or to retroactively arrange a ballast weight 10 or a plurality of ballast weights 10 having passages 10' at an existing work machine.

The ballast support 11 can be configured such that it is accessible, with a ballast weight 10 in place, from below and/or at least from one side to connect the coupling means to the ballast support 11 and/or to the ballast weight 10.

FIG. 2 shows that the passage 11' within the ballast support 11 can be configured as a bore or as another recess, in particular as a circular recess.

FIG. 3A shows a coupling means 2 that is configured as a steel cable and that can be partly led through the passage 11' of the ballast support 11 shown in FIG. 2. The coupling means 2 can be permanently provided within the passages 10', 11'. As can be seen from FIG. 1, it can be led at least partly through the passage 11' within the ballast support 11 so that it can be coupled by shape matching and/or form fitting to the ballast support 11 and/or to the ballast weight 10 by a cooperation of a coupling section 21 with a counter-coupling section 22 separable from the coupling means 2.

The passages in the ballast support and/or in the ballast weight can in particular be arranged in a vertical direction or in a direction differing from the vertical in a configuration ready for operation, for example with a ballast in place. The introduction of coupling means into the passages is hereby facilitated. It is also ensured in this manner that the coupling means extending in the passages are substantially arranged in the direction of force 116, whereby the risk of damage to the coupling means can be reduced. The direction of force in this context designates the direction in which the force acts that is transmitted by the coupling means.

FIG. 3B shows the coupling means 2 in which the coupling section 21 comprises a thread that can be connected to a counter-coupling section 22 formed as a nut. It is conceivable that a support 23 can furthermore be provided between the coupling section 21 and the counter-coupling section 22, in particular for a force distribution or pressure distribution. The support 23 can in this respect, also like the counter-coupling section 22, comprise a thread for securing or tightening the screw connection. The coupling or the apparatus can hereby be secured against an unwanted decoupling or releasing. The support 23 can also be understood as part of the counter-coupling section 22 and the counter-coupling section can act as or be called a securing means.

The coupling section 21 can be configured such that it comprises a first part that is configured for coupling the coupling section 21 to the ballast weight 10 and such that it comprises a second part that is configured for coupling the coupling section 21 to the counter-coupling section 22. The two parts can be arranged below one another. They can facilitate the lifting and coupling of the ballast weight 10 on the ballast support 11.

FIG. 3C shows an end region of the coupling means 2, with the coupling section 21 having a tapered portion into which the corresponding counter-coupling sections 22 can engage. The counter-coupling section 22 can be configured in two parts, as shown in FIG. 3C, or in one piece or one part, as shown in FIGS. 3D-3F. Embodiments of the counter-coupling section 22 are naturally also conceivable in which said counter-coupling section is built up of a number of sub-sections differing therefrom.

FIG. 3C shows the counter-coupling section 22 that is produced of two parts, in particular identical parts, that comprise semicircular plates having semicircular cut-outs. The counter-coupling sections 22 shown in FIG. 3C can be brought into engagement with the tapered portion of the coupling section 21 via the regions of the semicircular cut-outs and can fix the coupling means 2 to the ballast support 11, as can be seen from FIG. 1. The counter-coupling section 22 or the counter-coupling sections 22 can comprise one or more peripheral grooves and/or threads, in particular at their outer sides, that can be brought into engagement with at least one lug or one other capturing component. It is conceivable to provide passages or bores for this purpose that can be used to couple the at least one counter-coupling section 22 with the capturing component.

FIG. 3D and FIG. 3E show a counter-coupling section 22 that is produced in one piece and that comprises sections formed in hollow cylindrical shape and/or that comprises a recess 114 into which the coupling section 21 can be laterally introduced. In this respect, the coupling section 21 and the counter-coupling section can be fixed to one another via shape matching.

The counter-coupling section 22 produced in one piece and shown in FIG. 3F is similar thereto; it has a keyhole-shaped recess or a recess having an elongate hole and a recess, in particular a circular recess, connected thereto. The tapered portion of the coupling section 21 shown in FIG. 3C can be received within the elongate hole, while the coupling section 21 can first be led through the larger recess for this purpose.

Such a counter-coupling section 22 having a keyhole-shaped recess and also the other counter-coupling sections 22 and/or coupling sections 21 can comprise a securing device, not shown, by means of which the coupling section 21 can be permanently connected or secured to the counter-coupling section 22.

FIG. 4A shows two views of a cast ballast as a ballast weight 10 at the left in which the passages 10' are formed as cut-out or cast-in channels. These channels are at least partly exposed in their longitudinal directions. FIG. 4A shows two views of a cast ballast as a ballast weight 10 at the right in which the passages 10' are formed as countersunk or cast-in channels.

Figure 4B:
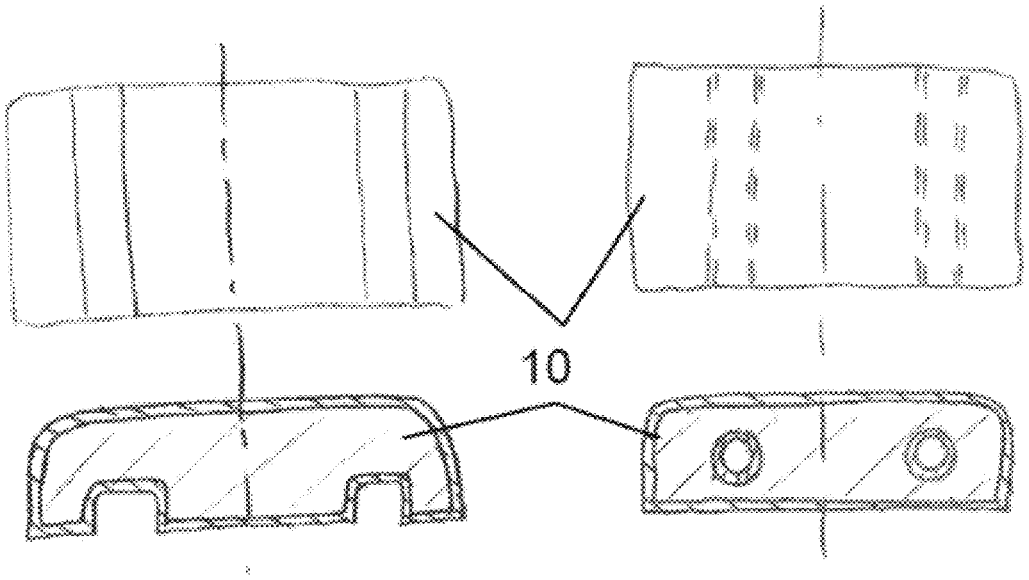

FIG. 4B shows at the left two views of a ballast weight 10 that is produced from a plurality of different materials and having cut-out channels or passages 10'. The right side of FIG. 4B correspondingly shows two views of a ballast weight 10 that is produced from a plurality of different materials and with inserted or welded-in hollow sections as passages 10'. A jacket layer of the ballast weight 10 can in this respect be produced from a respective metal, for example, with concrete, for example, being cast as a second material within the jacket layer.

Figure 4C:
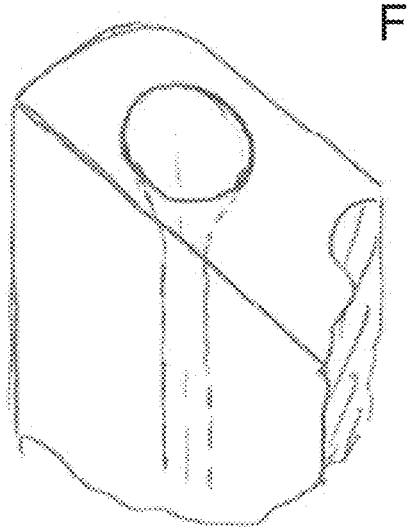
Figure 4D:
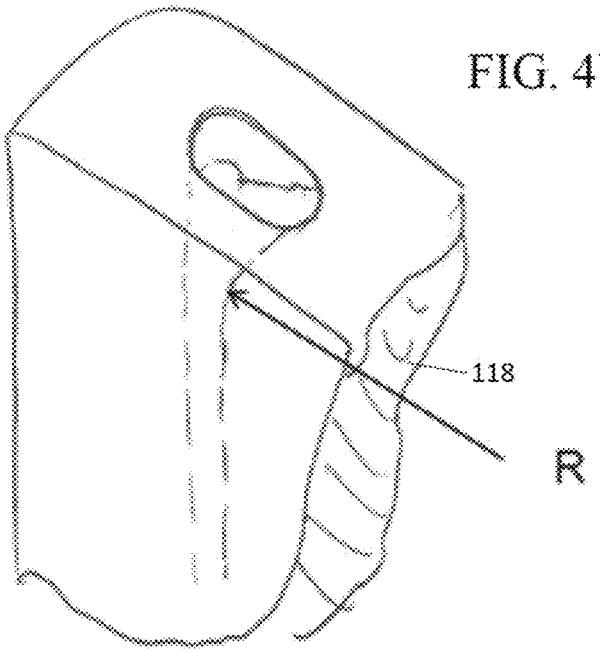

FIG. 4C and FIG. 4D show embodiments of the ballast weight 10 in which an upper opening of the passages 10' is in particular not formed as cylindrical, but rather as conical or with a widening cross-section such that the upper region is wider than the lower region. The opening of the passage 10' can comprise at least one wall that is curved with a radius R and that can be provided at the load side 118 (FIG. 4D) of the opening. The load on coupling means 2 led through the opening can hereby be reduced. In contrast to a cylindrical opening, the curved extent of the opening in the present disclosure may prevent damage to the coupling means 2. The opening can be rotationally symmetrical (FIG. 4C) or can only be curved at the load side, as described. The load side is in this context that side of the opening the coupling means 2 contacts on the lifting of the work machine, of the ballast weight, or both.

Figure 4E:
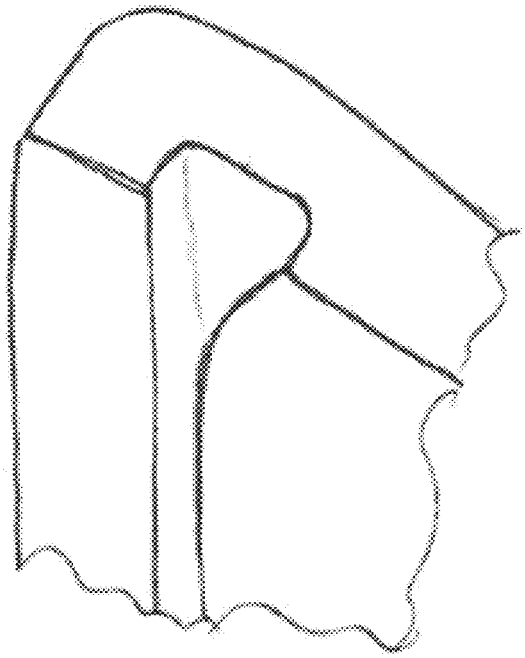
Figure 4F:
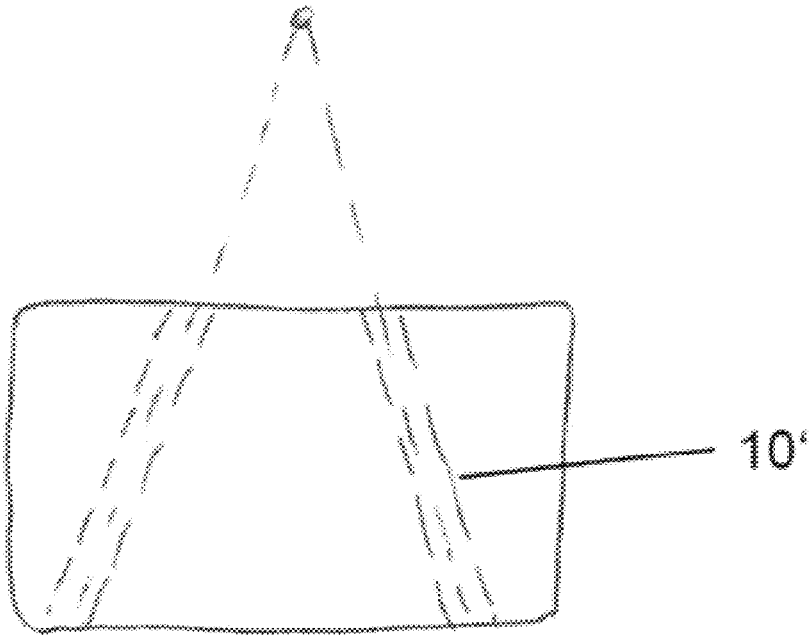

FIG. 4E shows a detail of a ballast weight 10 that can be formed as a cast ballast or as a welded ballast. The passages 10' can be formed as a cut-out channel or as cut-out channels. FIG. 4F shows that the passages 10' can be angled toward the vertical and can in particular be arranged in the load direction. The load direction can in this respect correspond to the direction in which the coupling means 2 are aligned on the lifting of the work machine, of the ballast weight 10, or both. The load on the coupling means 2 can hereby be further reduced. It is conceivable that the passages 11' of the ballast support 11 can be arranged correspondingly angled.

FIG. 4G and FIG. 4H show that the ballast weight 10 can be lifted without the work machine, with coupling means 2 being led through the passages 10' and being couplable to the ballast weight 10, for example, via shape matching and/or by using the coupling sections 21 and/or counter-coupling sections 22. It is in particular conceivable to design the passage 10' as wider in a lower region of the ballast weight 10 than in a middle region of the ballast weight 10 so that the ballast weight 10 can be fixed to the coupling section 21 and thus to the coupling means 2 simply by shape matching between the coupling section 21 and the ballast weight 10.

FIG. 4I shows the case in which the ballast weight 10 together with the ballast support 11 is fixed to the coupling means 2 both by means of the coupling section 21 and the counter-coupling section 22. The work machine can furthermore be lifted with and without a ballast weight 10 provided thereat by a direct coupling of the coupling means 2 to the passages 11' of the ballast support 11.

If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

The invention claimed is:

1. A work machine having at least one ballast device, wherein the ballast device comprises at least one ballast weight and at least one ballast support, wherein the ballast weight and the ballast support each comprise at least two passages, wherein each passage of the ballast weight and a respective passage of the ballast support are aligned with one another, and wherein the aligned passages contain coupling means, with an upper end of the coupling means configured to form lifting points for lifting the at least one ballast device and/or work machine, wherein the coupling means is a steel cable or chain, wherein an upper opening of the passages of the ballast weight is wider than a lower region of the passages, and wherein the upper opening of each of the two passages of the ballast weight curve towards each other.

2. The work machine in accordance with claim 1, wherein the passages are aligned with one another in a state of the work machine in which the work machine is at least partly ballast-compensated by the ballast weight.

3. The work machine in accordance with claim 1, wherein at least one of the passages is formed as a bore, a casting channel, an inserted hollow section and/or as a cut-out channel; and/or in that at least one of the passages comprises at least one bore, at least one casting channel, at least one inserted hollow section and/or at least one cut-out channel.

4. The work machine in accordance with claim 1, wherein a coupling section is at an end region of the coupling means and wherein the coupling section is surrounded by the support.

5. The work machine in accordance with claim 4, wherein the coupling section is coupled to a counter-coupling section for fixing the coupling means to the ballast device.

6. The work machine in accordance with claim 5, wherein the counter-coupling section is formed in one part or in two parts.

7. The work machine of claim 6, wherein the counter-coupling section comprises a recess configured to laterally receive the coupling section.

8. The work machine in accordance with claim 5, wherein the coupling section and the counter-coupling section respectively comprise a thread.

9. The machine of claim 5, wherein the coupling section has a first part configured for coupling to the ballast weight and a second part configured for coupling to the counter-coupling section.

10. The work machine in accordance with claim 1, wherein the ballast device is arranged at a superstructure of the work machine.

11. The ballast weight for work machine in accordance with claim 1, wherein the ballast weight comprises a slope, wherein the slope is in the direction of force.

12. The work machine of claim 1, wherein the passages are angled toward vertical in a load direction, wherein the load direction is a direction in which the coupling means are aligned on a lifting of the work machine.

13. The work machine of claim 1, wherein the passage extends through the ballast weight from a top of the ballast weight.

14. A work machine having at least one ballast device, wherein the ballast device comprises at least one ballast weight and at least one ballast support, wherein the ballast weight and the ballast support each comprise at least two passages, wherein each passage of the ballast weight and a respective passage of the ballast support are aligned with one another, and wherein the aligned passages contain coupling means, with an upper end of the coupling means configured to form lifting points for lifting the at least one ballast device and/or work machine, wherein an upper opening of the passages of the ballast weight is wider than a lower region of the passages, and wherein the upper opening is only curved on a load side, wherein the load side is a side of the upper opening the coupling means contacts on lifting of the work machine and/or ballast weight.

15. The work machine of claim 14, wherein the passage extends through the ballast weight from a top of the ballast weight.

16. The work machine of claim 14, wherein a coupling section is at an end region of the coupling means and wherein the coupling section is surrounded by the support.

17. The work machine in accordance with claim 16, wherein the coupling section is coupled to a counter-coupling section for fixing the coupling means to the ballast device.

18. The work machine in accordance with claim 17, wherein the counter-coupling section is formed in one part or in two parts.

* * * * *